US007152661B2

(12) United States Patent
Flemming et al.

(10) Patent No.: US 7,152,661 B2
(45) Date of Patent: Dec. 26, 2006

(54) METHOD AND CASTING ROLLER PLANT FOR THE SEMI-ENDLESS OR ENDLERS ROLLING BY CASTING OF A METAL IN PARTICULAR A STEEL STRIP WHICH MAY BE TRANSVERSELY SEPARATED AS REQUIRED AFTER SOLIDIFICATION

(75) Inventors: Günter Flemming, Erkrath (DE); Joachim Schwellenbach, Düsseldorf (DE); Hans Streubel, Erkrath (DE)

(73) Assignee: SMS Demag AG, Düsseldorf (DE)

( * ) Notice: Subject to any disclaimer, the term of this patent is extended or adjusted under 35 U.S.C. 154(b) by 15 days.

(21) Appl. No.: 10/518,085

(22) PCT Filed: May 2, 2003

(86) PCT No.: PCT/EP03/04599

§ 371 (c)(1),
(2), (4) Date: Dec. 15, 2004

(87) PCT Pub. No.: WO2004/004938

PCT Pub. Date: Jan. 15, 2004

(65) Prior Publication Data

US 2005/0251989 A1 Nov. 17, 2005

(30) Foreign Application Priority Data

Jul. 6, 2002 (DE) ..... 102 30 512
Oct. 25, 2002 (DE) ..... 102 49 704

(51) Int. Cl.
*B21B 1/46* (2006.01)

(52) U.S. Cl. ..... 164/477; 29/527.6

(58) Field of Classification Search ..... 164/476, 164/477, 417; 29/527.6, 527.7
See application file for complete search history.

(56) References Cited

U.S. PATENT DOCUMENTS 5,396,695 A 3/1995 Ginzburg et al.
5,771,560 A * 6/1998 Meroni et al. ..... 29/527.7

FOREIGN PATENT DOCUMENTS

EP 0853987 7/1998

* cited by examiner

*Primary Examiner*—Len Tran
(74) *Attorney, Agent, or Firm*—Friedrich Kueffner

(57) ABSTRACT

The invention relates to a method and casting roller plant for the semi-endless or endless rolling by casting of a metal, in particular a steel strip (1*a*), which may be transversely separated as required after solidification. The casting strip part lengths (20) are fed to a roller furnace (2) for heating and equilibration at the rolling temperature and the partial lengths (20) for rolling out are fed to a rolling train (3) for rolling, whereby the strip casting is continued uninterrupted during the rolling operation. According to the invention, a closer matching of the strip casting and the rolling can be carried out, whereby the casting speed ($V_c$) is reduced for a roller change such that between the end of rolling a preceding multiple length (21) and the insertion of a new partial length (20) or multiple lengths (21) into the rolling gear a sufficient buffer time for a roller exchange is provided.

8 Claims, 5 Drawing Sheets

1B
1B
Walzenwechsel $V_c < V_w$
2
1a
5

$V_c = V_w$
1a
2
1a
5

METHOD AND CASTING ROLLER PLANT FOR THE SEMI-ENDLESS OR ENDLERS ROLLING BY CASTING OF A METAL IN PARTICULAR A STEEL STRIP WHICH MAY BE TRANSVERSELY SEPARATED AS REQUIRED AFTER SOLIDIFICATION

BACKGROUND OF THE INVENTION

1. Field of the Invention

The invention concerns a method and a continuous casting and rolling plant for semi-endless or endless rolling by casting a metal strand, especially a steel strand, which is cut to length as required after solidification, wherein the cut lengths of cast strand are fed into a roller hearth furnace for heating and homogenizing at rolling temperature and are then fed at rolling temperature into a rolling mill to be rolled out, and wherein the continuous casting is continued without interruption during the rolling operation.

2. Description of the Related Art

A process of this type is described in EP 0 264 459 B1. In this method, the cut lengths of cast strand are stored in the roller hearth furnace with cross transport. The cut lengths of cast strand are stored for a period of time that is several times, e.g., four times, their casting time. Furthermore, the process is practiced in such a way that the rolling of each individual cut length of cast strand is carried out in a period of time that is only a fraction, e.g., one fifth, of its casting time and in such a way that the rolling is carried out discontinuously and the rolling operation is conducted with an interruption for a period of time that corresponds to the difference between a casting time and a rolling operation. This process operates strictly according to the continuous casting and is not coordinated with the rolling process.

SUMMARY OF THE INVENTION

The objective of the invention is to adjust the semi-endless rolling and endless rolling more closely to the conditions during rolling in order to match the rolling operation to the continuous casting operation with respect to time.

In accordance with the invention, this objective is achieved by reducing the casting rate for a roll change in such a way that a sufficient buffer time for a roll change is maintained between the end of the rolling of the preceding multiple length and the insertion of a new cut length or multiple length in the rolling mill. In this way, the semi-endless rolling and the endless rolling are adapted to the conditions of the rolling, and a buffer time is created for the inevitable roll change.

In this connection, the greater lengths of rolling stock that result from semi-endless or endless rolling are taken into consideration by producing several coils from a multiple length.

The buffer time for the roll change can also be influenced by reducing the casting rate as a function of the feed rate of the rolling mill and/or the roll-changing time, including the roll pass designing, and/or the buffer length of the roller hearth furnace and/or the final rolled thickness after the strand has been cut to length.

In accordance with another feature of the invention, it is proposed that the buffer length of the roller hearth furnace be adjusted at least to one roller plane.

Furthermore, to achieve the desired buffer time, it is advantageous for the casting rate $V_c$, which corresponds to the feed rate $V_w$ of the rolling mill, to be reduced by an amount greater than or equal to the amount given by the following formula:

$$\Delta V = V_w - \frac{1}{\Delta t / L + 1 / V_w} \text{ (m/min)}$$

where $\Delta V$=the reduction of the casting rate $V_w$=the feed rate of the rolling mill $\Delta t$=the roll-changing time and L=the length of the roller hearth furnace.

A further gain of time can be achieved by increasing the final rolled thickness and/or the feed rate of the rolling mill between rolling campaigns within a casting sequence after the strand has been cut to length.

Another embodiment of the invention consists in optimizing the production capacity by using a combination of adjustment of the casting rate and adjustment of the final rolled thickness.

In this connection, it is also advantageous if the final rolled thickness is increased by a maximum factor of 2.5.

A different buffer time can be achieved by increasing the final rolled thickness by a maximum factor of 2 and reducing the casting rate to a minimum of 30%.

In accordance with a practical example, the method can be used in such a way that, after the strand has been cut to length, the casting rate is reduced and/or the feed rate of the rolling mill and/or the final rolled thickness is increased, the worn rolls of the rolling mill are changed after completion of the rolling, and the casting rate is raised to the feed rate of the rolling mill after the roll change has been completed.

The continuous casting and rolling plant necessary for carrying out the method of the invention for semi-endless rolling or endless rolling of a cast metal or steel strand, which is cut to length as required in the solidified state, wherein the cut lengths of cast strand can be held at a high temperature and heated to rolling temperature and homogenized in a roller hearth furnace and can then be fed into a rolling mill, requires the successive arrangement of the continuous casting machine, a shearing station, a roller hearth furnace, other auxiliary pieces of equipment, a rolling mill, and a coiling installation at the end.

The continuous casting and rolling plant can then be operated by the method described above by providing a roller hearth furnace between the continuous casting machine and the rolling mill, which roller hearth furnace has at least one roller plane and a shearing station at its inlet or outlet, followed by a descaling system, which is followed by the rolling mill, which in turn is followed by a cutting station, a cooling station, and a coiling installation.

In one embodiment, in which there are at least two roller planes, swiveling roller conveyors, each of which has a bending and/or straightening unit, are installed at the inlet and outlet of the roller hearth furnace. The continuously cast strand can thus be precisely guided into the given roller plane.

The strand guide can be designed in such a way that multiple lengths can be fed at a single height level from the outlet of the continuous casting machine by the roller conveyor of the roller hearth furnace into the rolling mill.

The method and equipment of the invention are explained in greater detail below with reference to the specific embodiments illustrated in the drawings.

DETAILED DESCRIPTION OF THE INVENTION

Figure 1:
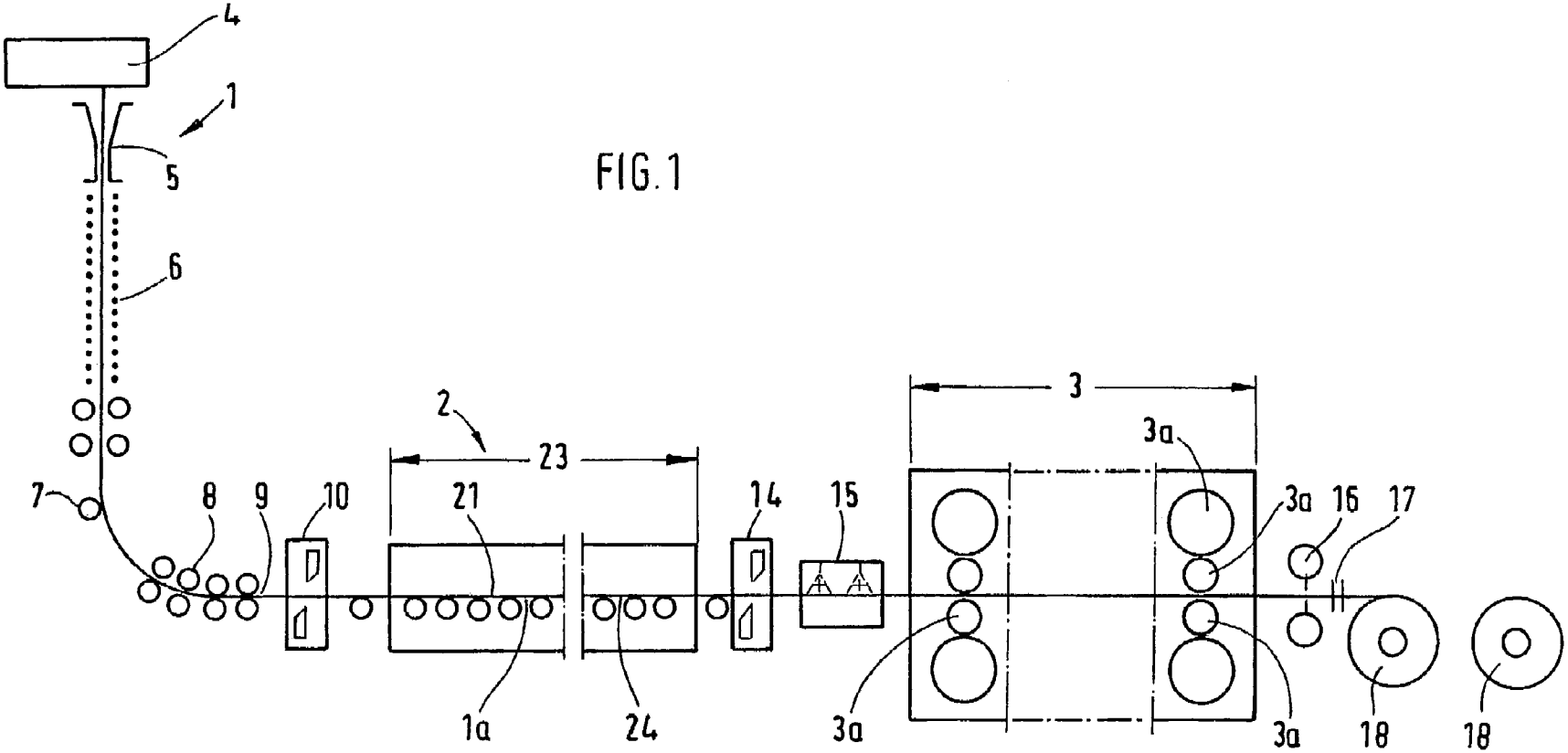
FIG. 1 shows the casting and rolling plant with a roller hearth furnace and a roller plane in a side view.

FIG. 1 shows a side view of a casting and rolling plant, which comprises a continuous casting machine 1 in which a cast strand 1*a* is produced, a roller hearth furnace 2, and a rolling mill 3 with its associated auxiliary equipment.

In the continuous casting machine 1, a tundish 4 is fed from a casting ladle (not shown). The tundish is followed by a continuous casting mold 5, a containment roll stand 6 with a bending unit 7, and a straightening machine 8. A shearing station 10 is installed at the outlet 9 of the continuous casting machine 1. The shearing station 10 is followed (as an alternative in FIG. 5) by a swiveling roller conveyor 11 for the inlet 12*a* of the roller hearth furnace 2. A swiveling roller conveyor 13 and a shearing station 14 are installed at the outlet 12*b* of the roller hearth furnace 2. The basic embodiment shown in FIG. 1 works without the swiveling roller conveyors 11, 13.

The shearing station 14 is followed by a descaling system 15, which is following by the rolling mill 3 with about five to seven rolling stands. The rolling stands are followed by a cutting station 16, a cooling station 17, and two coilers 18.

The method is used for semi-endless rolling or endless rolling by casting molten metal, especially molten steel, into a cast strand 1*a*, which, after it has solidified, is cut to length in the shearing station 10, and then conveying the cut lengths 20 of cast strand into the roller hearth furnace 2. Each cut length 20 of cast strand is heated in the roller hearth furnace 2, homogenized in temperature, and brought to rolling temperature, so that it can be rolled out in the rolling mill 3. During this period of time, the continuous casting continues without interruption.

When it becomes necessary to carry out a roll change due to wear of the rolls 3*a*, the casting rate $V_c$ is reduced to allow sufficient buffer time for the roll change between the end of the rolling of the preceding multiple length 21 and the insertion of a new cut length 20 or multiple length 21 in the rolling mill 3. Several coils 22 can be wound from the multiple length 21.

The casting rate $V_c$ is reduced, for example, as a function of the feed rate $V_w$ of the rolling mill 3 and/or of the given roll-changing time, including the roll pass designing, and/or the buffer length 23 of the roller hearth furnace 2 and/or the final rolled thickness after shearing. The buffer length 23 of the roller hearth furnace 2 can be adjusted at least to one roller plane 24.

Figure 2A:
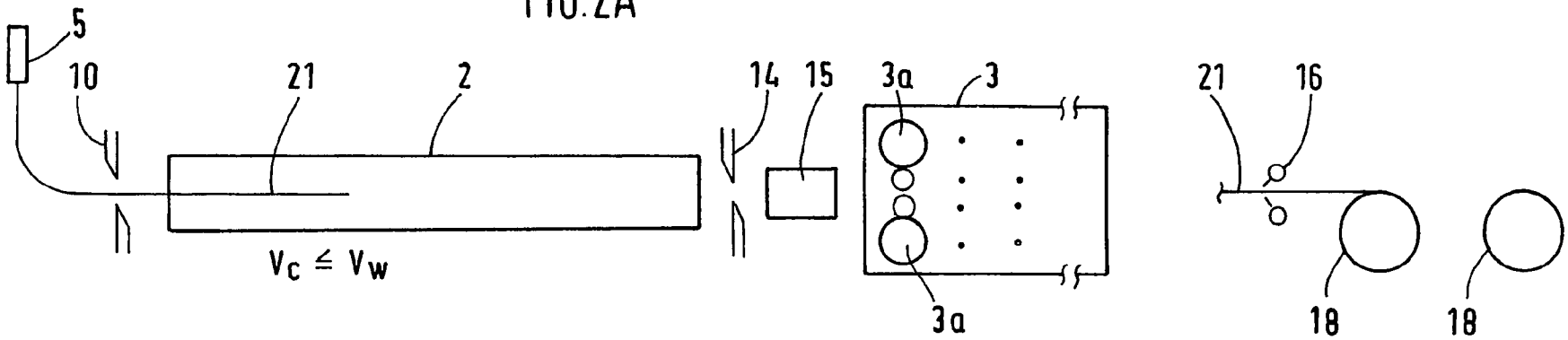
FIG. 2A shows a partial side view with a cast strand, with the casting rate less than or equal to the rolling rate.
Figure 2B:
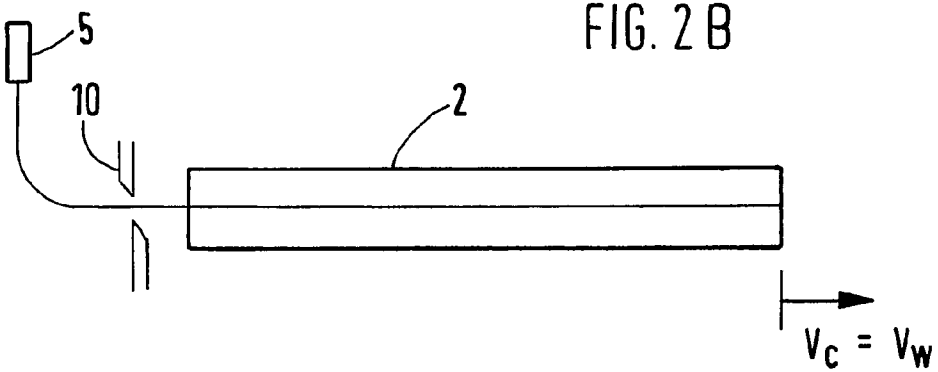
FIG. 2B shows the same view with the conveyance rate of a cut length of cast strand raised to the rolling rate.

In FIG. 2A, the casting rate $V_c$ is set less than or equal to the feed rate $V_w$ into the rolling mill 3. As soon as the roller hearth furnace 2 has been charged, the casting rate $V_c$ can be raised back to the feed rate $V_w$, as shown in FIG. 2B.

Figure 3A:
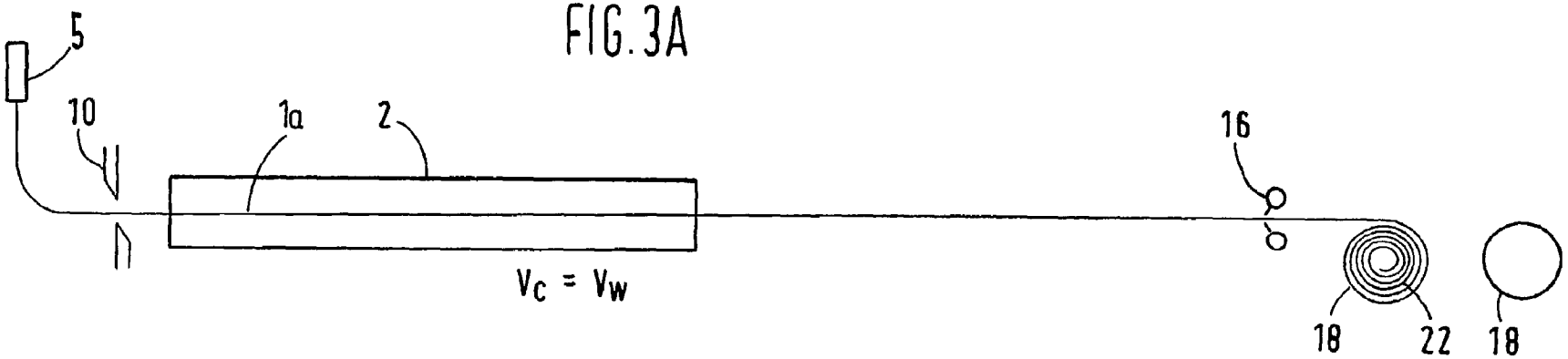
FIG. 3A shows endless casting and rolling at equal casting and rolling rates and with two coiling installations.
Figure 3B:
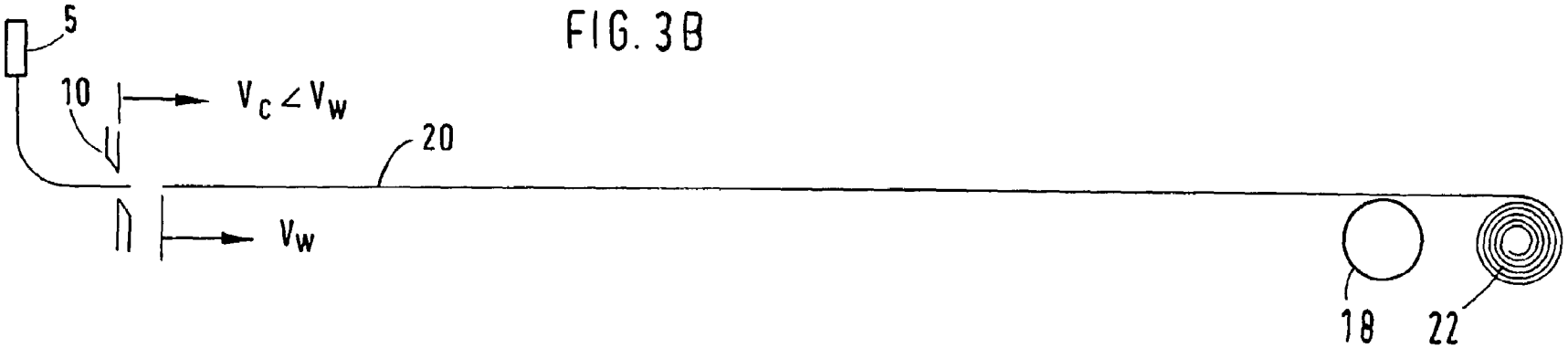
FIG. 3B shows endless casting and rolling with the two coiling installations.

Endless rolling is shown in FIG. 3A. The cast strand 1*a* is conveyed at the casting rate $V_c$, which is equal to the feed rate $V_w$ into the first rolling stand, and then rolled, cooled, coiled, and cut in the cutting station 16. As is shown in FIG. 3B, after the cast strand 1*a* has been cut to length in the shearing station 10, it can be cast at a reduced casting rate $V_c$, and the cut length of cast strand 20 is rolled and coiled at the feed rate $V_w$.

The casting rate $V_c$ is reduced by an amount greater than or equal to the amount given by the following formula:

$$\Delta V = V_w - \frac{1}{\Delta t / L + 1 / V_w} \text{ (m/min)}$$

where $\Delta V$=the reduction in the casting rate (m/min)

$V_w$=the feed rate of the rolling mill (m/min)

$\Delta t$=the roll-changing time (min)

L=the length of the roller hearth furnace (m).

At a feed rate $V_w$=10 m/min, a roll-changing time $\Delta t$=10 min, and a roller hearth furnace length L=200 m, the casting rate $V_c$ must be reduced by at least 3.33 m/min.

Reduction of the Casting Rate:

$$\begin{aligned}\Delta V &= 10 - \frac{1}{10/200 + 1/10} \\ &= 10 - \frac{1}{3/20} \\ &= 10 \text{ m} - 6.667 \text{ m} \\ &= 3.33 \text{ m/min}\end{aligned}$$

Figures 4A, 4B:
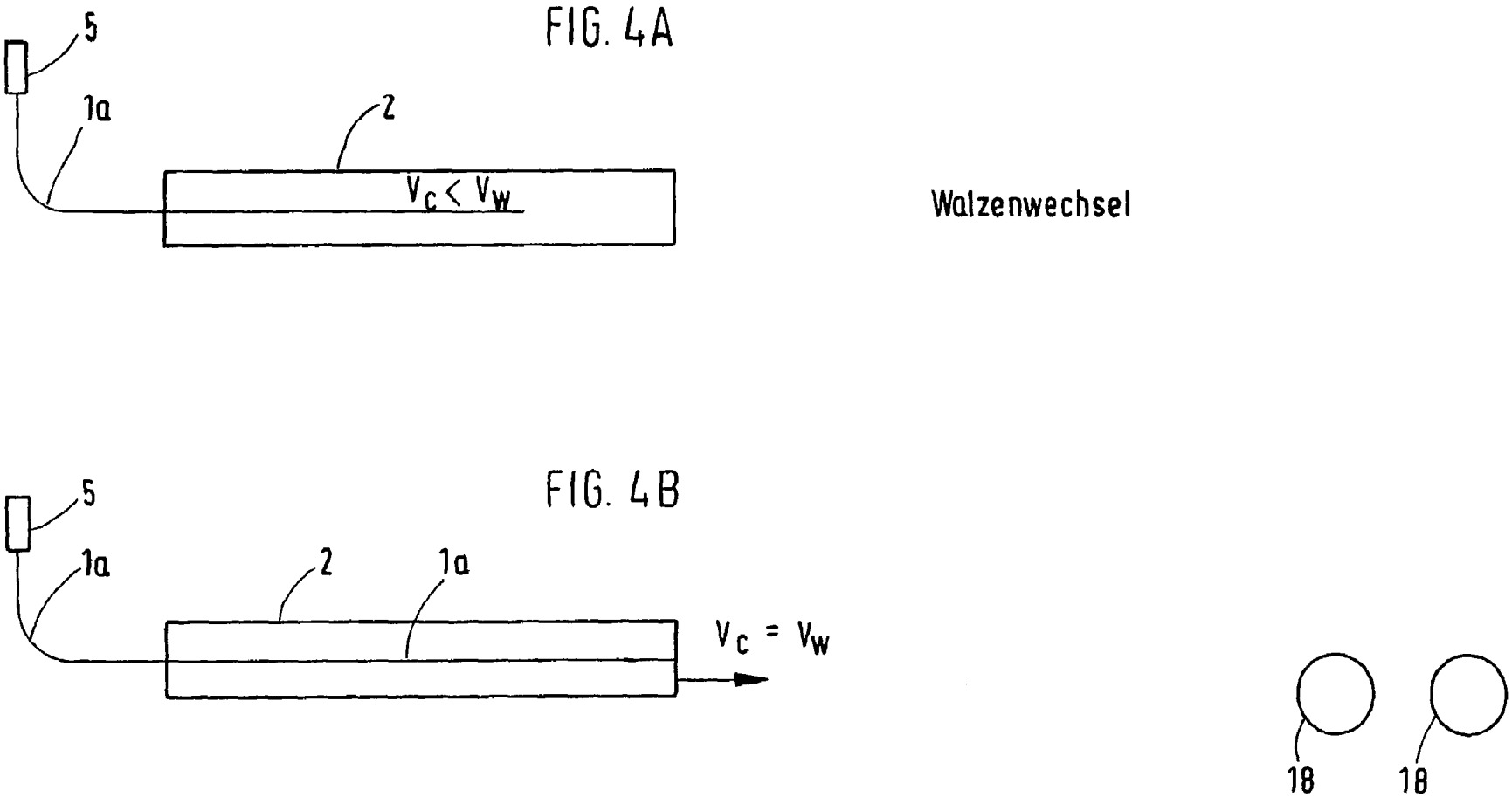
FIG. 4A shows the situation during a roll change and at reduced casting rate.
FIG. 4B shows the situation after the roll change has been completed and the casting rate has been raised.

The roll change is shown in FIG. 4A. According to the above calculation, the casting rate $V_c$ is 6.67 m/min and is thus lower than the feed rate $V_w$. After the roll change (FIG. 4B), the casting rate $V_c$ is raised to the feed rate $V_w$ again.

Between the rolling campaigns within a casting sequence, the final rolled thickness and/or the feed rate $V_w$ can be increased after the strand has been cut to length.

However, it is also possible to use a combination of adjustment of the casting rate $V_c$ and adjustment of the final rolled thickness to optimize the production capacity. In this connection, the final rolled thickness can be increased by a maximum factor of 2.5. Another option is to increase the final rolled thickness by a maximum factor of 2 and to reduce the casting rate to a minimum of 30%.

In another embodiment, after the strand has been cut to length, the casting rate $V_c$ is reduced, and/or the feed rate $V_w$ of the rolling mill 3 and/or the final rolled thickness is increased; upon completion of rolling, the worn rolls 3*a* of the rolling mill 3 are changed; and after the roll change has been completed, the casting rate $V_c$ is increased to the feed rate $V_w$ of the rolling mill 3.

The continuous casting and rolling plant for semi-endless rolling or endless rolling of a cast metal or steel strand, which is cut to length as required in the solidified state to produce cut lengths 20 of the cast strand 1*a*, wherein the cut lengths 20 of cast strand 1*a* are held at a high temperature and heated to rolling temperature and homogenized in a roller hearth furnace 2 and are then fed into a rolling mill 3, requires that the continuous casting machine 1 cast the strand continuously. To this end, the roller hearth furnace 2 with at least one roller plane 24 is installed between the continuous casting machine 1 and the rolling mill 3 and at its inlet 12*a* and/or outlet 12*b* has a shearing station 14, followed by a descaling system 15, which is followed by the first rolling stand, and the rolling mill 3 is following by the cutting station 16, cooling station 17, and coilers 18.

The roller conveyors 11, 13 on the run-in side and the runout side have bending and/or straightening units 7, 8, which can be set or adjusted to the given roller plane 24. The swiveling roller conveyors 11, 13 at the inlet 12*a* and at the outlet 12*b* of the roller hearth furnace 2 with at least two roller planes 24 are thus each provided with a bending and/or straightening unit 7, 8 (cf. FIG. 5).

Figure 5:
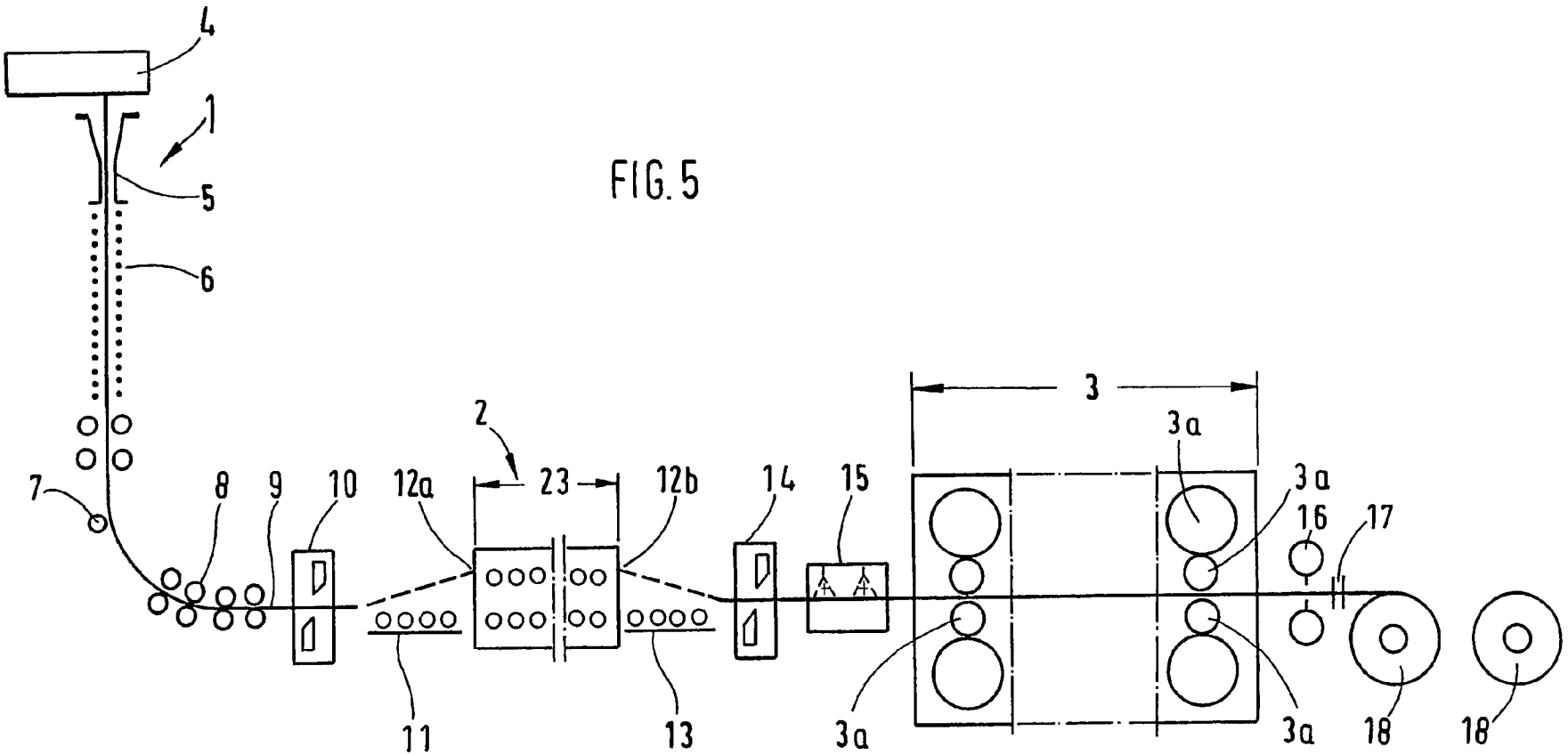
FIG. 5 shows the casting and rolling plant in the same side view as FIG. 1 for an alternative embodiment.

In accordance with the alternative design in FIG. 5, multiple lengths 21 on several roller planes 24 can be passed by the swiveling roller conveyor 11 of the roller hearth furnace 2 and the swiveling roller conveyor 13 from the outlet 9 of the continuous casting machine 1 to the rolling mill 3.

LIST OF REFERENCE NUMBERS

1 continuous casting machine
1*a* cast strand
2 roller hearth furnace
3 rolling mill
3*a* roll
4 tundish
5 continuous casting mold
6 containment roll stand
7 bending unit
8 straightening machine
9 outlet [of the continuous casting machine 1]
10 shearing station
11 roller conveyor
12*a* inlet [of the roller hearth furnace 2]
12*b* outlet [of the roller hearth furnace 2]
13 roller conveyor
14 shearing station
15 descaling system
16 cutting station
17 cooling station
18 coiler
19
20 cut length of cast strand
21 multiple length
22 coil
23 buffer length
24 roller plane

The invention claimed is:

1. Method for semi-endless or endless rolling by casting a metal strand, especially a steel strand (1*a*), which is cut to length as required after solidification, wherein the cut lengths (20) of cast strand are fed into a roller hearth furnace (2) for heating and homogenizing at rolling temperature and are then fed at rolling temperature into a rolling mill (3) to be rolled out, wherein the continuous casting is continued without interruption during the rolling operation, and wherein a sufficient buffer time for a roll change is maintained in the rolling mill, wherein, to carry out a roll change, the casting rate (Vc) is reduced as a function of the feed rate (Vw) of the rolling mill (3) and/or the roll-changing time, including the roll pass designing, and/or the buffer length of the roller hearth furnace (2) and/or the final rolled thickness after the strand has been cut to length, wherein the casting rate (Vc) is reduced by an amount greater than or equal to the amount given by the following formula:

$$\Delta V = V_w - \frac{1}{\Delta t / L + 1 / V_w} \text{ (m/min)}$$

where

V=the reduction of the casting rate
Vw=the feed rate of the rolling mill
t=the roll-changing time
L=the length of the roller hearth furnace.

2. Method in accordance with claim 1, wherein several coils (22) are produced from a multiple length (21).

3. Method in accordance with claim 1, wherein the buffer length (23) of the roller hearth furnace (2) is adjusted at least to one roller plane (24).

4. Method in accordance with claim 1, wherein the final rolled thickness and/or the feed rate (Vw) of the rolling mill is increased between rolling campaigns within a casting sequence after the strand has been cut to length.

5. Method for semi-endless or endless rolling by casting a metal strand, especially a steel strand (1*a*), which is cut to length as required after solidification, wherein the cut lengths (20) of cast strand are fed into a roller hearth furnace (2) for heating and homogenizing at rolling temperature and are then fed at rolling temperature into a rolling mill (3) to be rolled out, wherein the continuous casting is continued without interruption during the rolling operation, and wherein a sufficient buffer time for a roll change is maintained in the rolling mill, wherein, to carry out a roll change, the casting rate (Vc) is reduced as a function of the feed rate (Vw) of the rolling mill (3) and/or the roll-changing time, including the roll pass designing, and/or the buffer length of the roller hearth furnace (2) and/or the final rolled thickness after the strand has been cut to length, wherein the final rolled thickness and/or the feed rate (Vw) of the rolling mill is increased between rolling campaigns within a casting sequence after the strand has been cut to length, and wherein a combination of adjustment of the casting rate (Vc) and adjustment of the final rolled thickness is used to optimize the production capacity.

6. Method for semi-endless or endless rolling by casting a metal strand, especially a steel strand (1*a*), which is cut to length as required after solidification, wherein the cut lengths (20) of cast strand are fed into a roller hearth furnace (2) for heating and homogenizing at rolling temperature and are then fed at rolling temperature into a rolling mill (3) to be rolled out, wherein the continuous casting is continued without interruption during the rolling operation, and wherein a sufficient buffer time for a roll change is maintained in the rolling mill, wherein, to carry out a roll change, the casting rate (Vc) is reduced as a function of the feed rate (Vw) of the rolling mill (3) and/or the roll-changing time, including the roll pass designing, and/or the buffer length of the roller hearth furnace (2) and/or the final rolled thickness after the strand has been cut to length, wherein the final rolled thickness and/or the feed rate (Vw) of the rolling mill is increased between rolling campaigns within a casting sequence after the strand has been cut to length, and wherein the final rolled thickness is increased by a maximum factor of 2.5.

7. Method for semi-endless or endless rolling by casting a metal strand, especially a steel strand (*a*), which is cut to length as required after solidification, wherein the cut lengths (20) of cast strand are fed into a roller hearth furnace (2) for heating and homogenizing at rolling temperature and are then fed at rolling temperature into a rolling mill (3) to be rolled out, wherein the continuous casting is continued without interruption during the rolling operation, and wherein a sufficient buffer time for a roll change is maintained in the rolling mill, wherein, to carry out a roll change, the casting rate (Vc) is reduced as a function of the feed rate (Vw) of the rolling mill (3) and/or the roll-changing time, including the roll pass designing, and/or the buffer length of the roller hearth furnace (2) and/or the final rolled thickness after the strand has been cut to length, wherein the final rolled thickness and/or the feed rate (Vw) of the rolling mill is increased between rolling campaigns within a casting sequence after the strand has been cut to length, and wherein the final rolled thickness is increased by a maximum factor of 2, and the casting rate (Vc) is reduced to a minimum of 30%.

8. Method in accordance claim 1, wherein after the strand has been cut to length, the casting rate (Vc) is reduced, and/or the feed rate (Vw) of the rolling mill (3) and/or the final rolled thickness is increased; upon completion of rolling, the worn rolls (3*a*) of the rolling mill (3) are changed; and after the roll change has been completed, the casting rate (Vc) is increased to the feed rate (Vw) of the rolling mill (3).

* * * * *